United States Patent [19]

Pulkkinen

[11] Patent Number: 4,717,285

[45] Date of Patent: Jan. 5, 1988

[54] CISTERN FOR LIQUID OR GAS, CONSTRUCTED OF REINFORCED CONCRETE

[75] Inventor: Jorma Pulkkinen, Porvoo, Finland

[73] Assignee: Neste Oy, Finland

[21] Appl. No.: 860,225

[22] PCT Filed: Sep. 5, 1984

[86] PCT No.: PCT/FI84/00062

§ 371 Date: Apr. 29, 1986

§ 102(e) Date: Apr. 29, 1986

[87] PCT Pub. No.: WO86/01559

PCT Pub. Date: Mar. 13, 1986

[51] Int. Cl.[4] ..... E02D 27/00

[52] U.S. Cl. ..... 405/55; 405/133; 52/169.6

[58] Field of Search ..... 405/52, 133, 55, 146, 405/147; 52/169.7, 169.6

[56] References Cited

U.S. PATENT DOCUMENTS

| | | | |
|---|---|---|---|
| 3,151,416 | 10/1964 | Eakin | 405/55 |
| 3,984,956 | 10/1976 | Oger | 405/133 |
| 4,241,762 | 12/1980 | Link | 405/133 |
| 4,425,743 | 1/1984 | Bartur | 52/169.1 |

FOREIGN PATENT DOCUMENTS

| | | | |
|---|---|---|---|
| 301200 | 10/1913 | Fed. Rep. of Germany | 405/133 |
| 429721 | 6/1926 | Fed. Rep. of Germany | 405/133 |
| 933564 | 9/1955 | Fed. Rep. of Germany | 405/133 |
| 1240548 | 5/1967 | Fed. Rep. of Germany | 405/147 |
| 2050806 | 4/1972 | Fed. Rep. of Germany | 405/133 |
| 80090 | 6/1955 | Netherlands | 405/133 |
| 214095 | 4/1924 | United Kingdom | 405/133 |
| 563499 | 7/1977 | U.S.S.R. | 405/133 |

*Primary Examiner*—Henry E. Raduazo

*Attorney, Agent, or Firm*—Steinberg & Raskin

[57] ABSTRACT

The invention concerns a cistern structure intended to be used as a subterranean cistern. The shell of the cistern has been formed of a material impermeable to the substance to be stored therein. The shell of the cistern has been encircled with mutually spaced annular juncture elements (13). The juncture elements (13) have been provided with anchoring elements (14) by the aid of which the cistern has been anchored in the rock or soil. The shell of the cistern is supported by a supporting layer in concrete construction, and the shell consists of sheet steel (12). The shell of the cistern is advantageously composed of element-designed components (11). The element-designed components (11) one upon the other have been joined to become a compound structure, with the aid of a juncture element (13). The juncture element (13) is advantageously a concrete ring cast on site. The space between juncture elements (13) is filled with an intermediate material (15), such as sand, gravel, light-weight gravel or thermal lagging.

20 Claims, 3 Drawing Figures

CISTERN FOR LIQUID OR GAS, CONSTRUCTED OF REINFORCED CONCRETE

BACKGROUND OF THE INVENTION

The present invention concerns a cistern structure intended to be used as a subterranean cistern and of which the shell has been formed of a material impermeable to the material to be stored therein.

Steel-lined subterranean oil cisterns have heretofore been built in the manner that the space between the sheet steel shell of the cistern and the rock has been completely filled with concrete by pouring. The thickness of the concrete layer has then varied in the range from 0.1 to 2 meters, depending on the accuracy with which the rock blasting has been done. The drawback encumbering such cisterns is, above all, that in the construction job immense quantities of concrete are required, with the result that the constructing of the cistern is extremely costly. From the detrimental heat generation of the concrete arises the drawback that the steel wall tends to become wavy, for which reason one is generally compelled to use a relatively thick steel wall and bolting with very close spacing. The massive concrete envelope precludes the use of the cistern as storage for cold liquids because the steel shell tends to become detached from the concrete shell. In high cisterns, the ground water pressure causes detrimental stresses acting on the structure, in spite of the draining that is applied. This mode of construction of prior art is also time-consuming, with the result that the total cost of the cistern will be high. The use of poured concrete is advocated by the fact that the corrosion phenomenon occuring in a thick steel shell can be managed by the aid of concrete pouring.

SUMMARY OF THE INVENTION

The object of the invention is to achieve an improvement of cistern structures known in the art. The more detailed object of the invention is to provide a subterranean cistern in which a substantially thinner steel shell can be used. It is a further object of the invention to provide a subterranean cistern in the constructing of which considerably less concrete is needed. One object of the invention is to provide a subterranean cistern in which cold liquids may also be stored with ease. It is also an object of the invention to provide a subterranean cistern which is free of problems caused by water. One further object of the invention is to provide a subterranean cistern which is fast as to its mode of erection and considerably less expensive of its construction costs.

The aims of the invention are achieved by means of a subterranean cistern structure which is mainly characterized in that the shell of the cistern is encircled by annular juncture elements spaced with reference to each other and which are provided with anchoring elements by the aid of which the cistern is anchored in the rock or in the soil.

The rest of the characteristic features of the cistern structure of the invention will be apparent below.

By the cistern structure according to the invention, numerous significant advantages are gained. The steel shell of the subterranean cistern structure can be made considerably less in thickness. Moreover, far less concrete is needed than in any equivalent structures of prior art. In a cistern meant for storing cold liquids, the concrete ring serving as juncture element may be thermally lagged against the rock at the points between the anchoring points which are indispensable for support. In the subterranean cistern structure of the invention, the ground water problem can also be solved in a reliable way. The invention furthermore enables an extraordinarily inexpensive and fast mode of construction, as a result of which the shell structure of the subterranean cistern of the invention will be considerably less expensive than the structure of prior art concreted on site.

Furthermore, the comparatively light and ductile structure of the invention has a better tolerance of earthquakes; it is easy to modify the strength of the structure to be consistent with the load; and the accuracy with which the wall of the excavation is made has no decisive influence on the building costs.

BRIEF DESCRIPTION OF THE DRAWINGS

The invention is described in detail in the following, reference being made to certain advantageous embodiments of the invention, presented in the figures of the attached drawings, but to which the invention is not meant to be exclusively confined.

DESCRIPTION OF THE PREFERRED EMBODIMENTS

Figure 1:
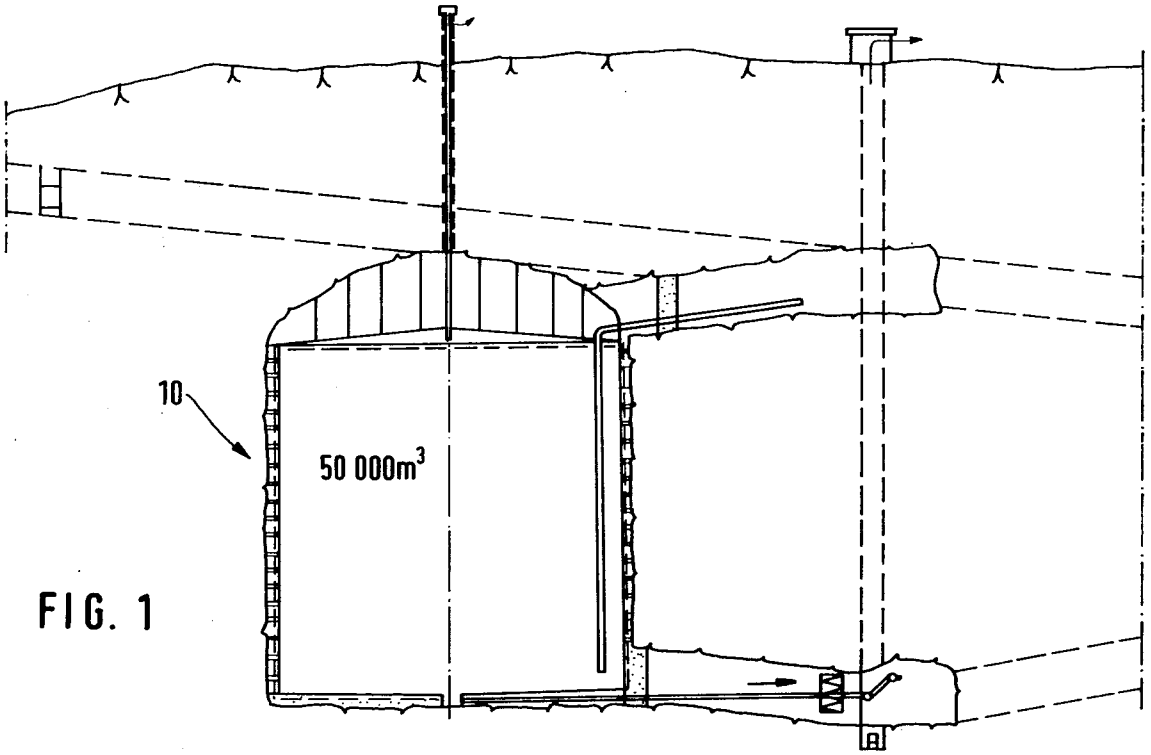
FIG. 1 presents, in schematical elevational view, a subterranean cistern.
Figure 2:
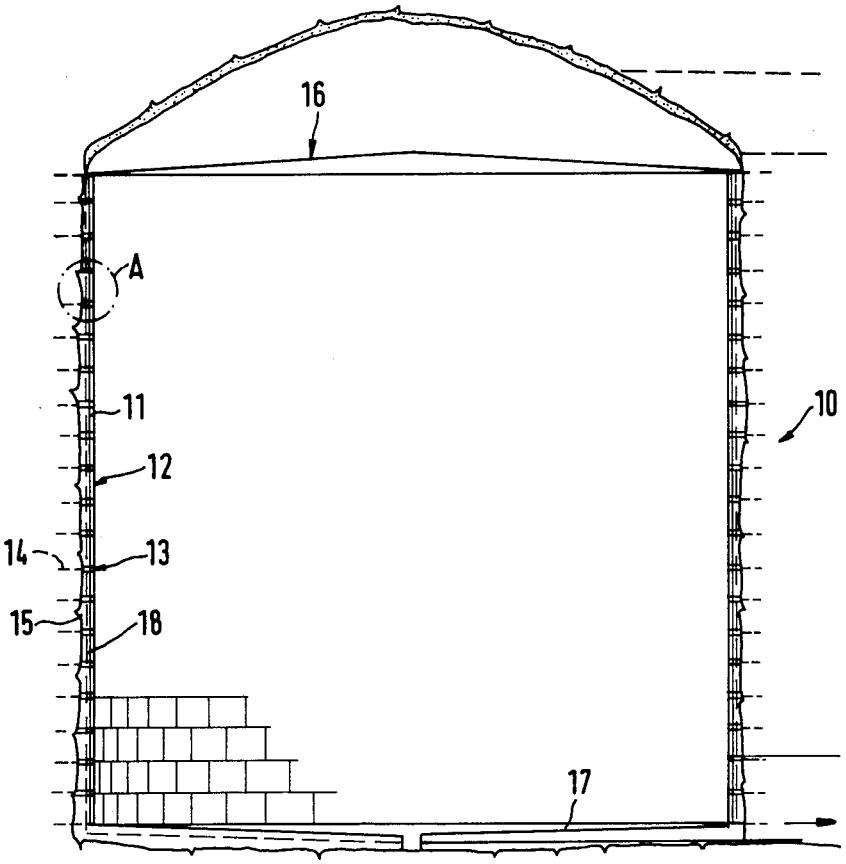
FIG. 2 presents in schematical elevational view an advantageous embodiment of the subterranean cistern structure of the invention.
Figure 3:
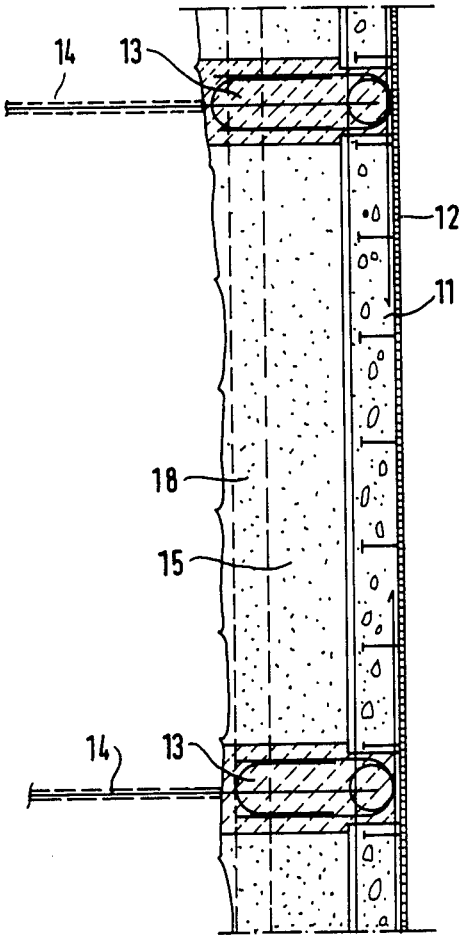
FIG. 3 shows the vertical section of the detail A in FIG. 2.

In the embodiment depicted in FIGS. 1–3, the subterranean cistern structure of the invention has been generally indicated with the reference numeral 10. In this embodiment, the shell of the cylindrical cistern 10 has been made of reinforced concrete elements 11 which have a steel sheet 12 for their inside surface. The reinforced steel elements 11 find support against reinforced steel rings 13 encircling the cistern 10 in the horizontal plane and which are concreted on site, in step with the progress of the installation work. The reinforced steel rings 13 are anchored in the rock or soil with steel bolts 14. The space between the shell of the cistern 10 and the wall of the excavation is filled with light-weight gravel or natural gravel 15, or with another filling material. The roof 16 of the cistern 10 may be constructed of similar steel-lined concrete elements as the reinforced concrete elements 11. In a cistern for liquid, however, it is to greatest advantage to make the roof 16 and the bottom 17 of sheet steel, in a way known in the art. In cold cisterns the roof must also be thermally lagged. In the shell of the cistern 10 and on its bottom are installed subdrainage pipes 18, which lead off any leakage water from the excavation.

Thus, it is peculiar in the subterranean cistern structure of the invention that the shell of the cistern 10 has been encircled with mutually spaced annular juncture elements 13. The juncture elements 13 have been provided with anchoring elements 14, by the aid of which the cistern 10 is anchored in the rock or in the soil. The invention is not critical as regards the material of the shell of the cistern 10. The shell is advantageously supported with a supporting layer in concrete construction, and it consists advantageously of sheet steel 12. The shell is advantageously formed of element-designed components 11, and such element-designed components 11 one above the other have been joined to become a compound structure, with the aid of the juncture element 13. The juncture element 13 is advantageously a concrete ring concreted on site. The concrete ring 13 may be insulated from the rock by means of a suitable thermal lagging, in which case the cistern 10 is also applicable as storage place for extremely cold liquids. The concrete ring is anchored at given points in the rock, and is thermally insulated from the rock on the remaining parts thereof. The space between the juncture elements 13 is filled with a suitable intermediate material 15. The intermediate material 15 is advantageously a material well permeable to water, such as sand, gravel, light-weight gravel or equivalent. In certain applications, the intermediate material 15 is a thermal insulator, such as polyurethane, light-weight gravel concrete, foamed glass or equivalent. The intermediate material 15 may consist of soil from the building site, for instance when the cistern is constructed downwards from above.

In those applications in which the shell of the cistern 10 need not absolutely consist of sheet steel 12, the shell may consist of e.g. of some kind of coating, for instance, of reinforced plastic or of the mere concrete element.

In the foregoing, only advantageous embodiments of the invention have been presented, and it is obvious to a person skilled in the art that numerous modifications of them are possible within the scope of the inventive idea.

I claim:

1. A cistern structure for use as a subterranean cistern, comprising:

a shell forming an inner surface of said cistern structure and formed of a material impermeable to substance to be stored therewithin;

a plurality of mutually-spaced, annular juncture elements, encircling said shell;

at least one anchoring element provided in each juncture element for anchoring said cistern structure into surrounding rock or soil;

a plurality of structural elements arranged one above the other and joined with said annular juncture elements to form a compound structure; and an intermediate layer of material situated between said mutually-spaced juncture elements.

2. The combination of claim 1, wherein said juncture elements are formed of concrete.

3. The combination of claim 1, wherein said shell is a sheet.

4. The combination of claim 3, wherein said shell is a steel sheet.

5. The combination of claim 1, wherein said shell is formed of reinforced plastic.

6. The combination of claim 1, wherein said juncture elements are ring-shaped.

7. The combination of claim 1, wherein said annular juncture elements and said structural elements are alternately arranged in said compound structure.

8. The combination of claim 2, wherein each said juncture element is a concrete ring.

9. The combination of claim 8, wherein said concrete rings are cast on construction of said cistern structure.

10. The combination of claim 8, additionally comprising a plurality of anchoring elements anchoring each said juncture element into the surrounding rock or soil, at given points, and with said juncture elements being thermally insulated at the remaining locations from the rock or soil.

11. The combination of claim 1, additionally comprising thermal lagging insulating each said juncture element from the rock or soil.

12. The combination of claim 1, wherein said intermediate layer is water-permeable.

13. The combination of claim 1, wherein said intermediate layer is a thermal-insulating layer.

14. The combination of claim 1 wherein said anchoring elements are steel bolts.

15. The combination of claim 14, wherein said steel bolts extend into the rock or soil substantially perpendicularly to a plane of said inner surface.

16. The combination of claim 12, wherein the material of said intermediate layer is sand, gravel, or soil.

17. The combination of claim 13, wherein the material of said intermediate layer is polyurethane, light-weight gravel, concrete, or foamed glass.

18. The combination of claim 2, wherein said juncture elements are reinforced with steel.

19. The combination of claim 1, wherein said structural elements are reinforced with steel.

20. The combination of claim 1, wherein said structural elements are formed of concrete reinforced with steel.

* * * * *